US008231017B2

(12) United States Patent
Clontz et al.

(10) Patent No.: US 8,231,017 B2
(45) Date of Patent: Jul. 31, 2012

(54) DISPLAY OF VIDEO AND OTHER CONTENT IN RETAIL STORES

(75) Inventors: John Robert Clontz, Heath, TX (US); Joshua Warren-Louis Logan, Opelika, AL (US)

(73) Assignee: Madix, Inc., Terrell, TX (US)

( * ) Notice: Subject to any disclaimer, the term of this patent is extended or adjusted under 35 U.S.C. 154(b) by 0 days.

(21) Appl. No.: 12/518,241

(22) PCT Filed: Dec. 7, 2007

(86) PCT No.: PCT/US2007/086797

§ 371 (c)(1),
(2), (4) Date: Jun. 17, 2009

(87) PCT Pub. No.: WO2008/073829

PCT Pub. Date: Jun. 19, 2008

(65) Prior Publication Data

US 2010/0012600 A1 Jan. 21, 2010

Related U.S. Application Data

(60) Provisional application No. 60/869,174, filed on Dec. 8, 2006.

(51) Int. Cl.
*A47F 5/00* (2006.01)

(52) U.S. Cl. ..... 211/134; 211/26; 312/246

(58) Field of Classification Search ..... 211/26, 211/85.26, 84, 83, 71.01, 151, 126.15, 134; 235/383; 312/208.2, 351, 208.1, 246, 302, 312/303; 108/26, 40, 92, 93, 184, 108
See application file for complete search history.

(56) References Cited

U.S. PATENT DOCUMENTS

| | | | | |
|---|---|---|---|---|
| 2,285,491 | A * | 6/1942 | Clark | 211/36 |
| 4,530,549 | A | 7/1985 | Genna | |
| 5,160,051 | A | 11/1992 | Bustos | |
| 5,176,224 | A * | 1/1993 | Spector | 186/52 |
| 5,405,193 | A | 4/1995 | Herrenbruck | |
| 5,531,159 | A * | 7/1996 | Stubblefield | 108/102 |
| 5,553,412 | A | 9/1996 | Briechle et al. | |
| 5,660,287 | A | 8/1997 | Tryon | |
| 5,821,512 | A * | 10/1998 | O'Hagan et al. | 235/383 |
| 5,924,663 | A | 7/1999 | Gatto | |
| 6,016,481 | A | 1/2000 | Failing, Jr. et al. | |

(Continued)

OTHER PUBLICATIONS

PCT International Search Report mailed Jun. 2, 2008 for PCT/US07/86797.

(Continued)

*Primary Examiner* — Darnell Jayne
*Assistant Examiner* — Patrick Hawn
(74) *Attorney, Agent, or Firm* — Hitchcock Evert LLP

(57) ABSTRACT

A shelf for use in a conventional retail display gondola or perimeter wall shelving includes an upper support surface for merchandise and an enclosure below that surface in which electronic components including a thin client computer or a media player are housed. A video display monitor has a screen visible through an opening in a front face of the shelf. The enclosure is usually secured to deny access to the electronic component, but can be opened to provide access to the electronic components housed therein.

24 Claims, 6 Drawing Sheets

U.S. PATENT DOCUMENTS

| | | | | |
|---|---|---|---|---|
| 6,119,990 | A * | 9/2000 | Kump et al. | 248/220.22 |
| 6,550,673 | B2 | 4/2003 | Massaro | |
| 7,072,179 | B1 | 7/2006 | Curran et al. | |
| 7,260,438 | B2 * | 8/2007 | Caldwell et al. | 700/60 |
| 7,316,378 | B1 | 1/2008 | Curran et al. | |
| 2002/0194081 | A1 * | 12/2002 | Perkowski | 705/26 |
| 2003/0085275 | A1 | 5/2003 | Barkan | |
| 2003/0115096 | A1 | 6/2003 | Reynolds et al. | |
| 2005/0161420 | A1 * | 7/2005 | Hardy et al. | 211/189 |
| 2006/0131250 | A1 * | 6/2006 | Richardson et al. | 211/50 |

OTHER PUBLICATIONS

Madix, Gondola/Wall Shelving, Specialty Shelves, catalog, 2005, May 2005, 1 page (no longer available) reprinted as Madix, Gondola/Wall Shelving, Specialty Shelves, Catalog 2006, May 2006.

Madix, Invest in Your Bottom Line, Lighted Step Back Shelves, brochure, 2006, Madix, Inc., 2 pages.

Madix, New Products, catalog, Spring 2006, Madix, Inc., pp. 1-44.

* cited by examiner

DISPLAY OF VIDEO AND OTHER CONTENT IN RETAIL STORES

CROSS-REFERENCE TO RELATED APPLICATION

This application claims the benefit of priority from U.S. Provisional Application Ser. No. 60/869,174 filed on Dec. 8, 2006.

FIELD OF THE INVENTION

The present invention relates to the display of video and other content to customers in retail stores and to a shelf device for delivering that content.

BACKGROUND OF THE INVENTION

Many proposals have been made in recent years to display video and other digital content of interest to customers in retail stores. Many of these proposals involve the use of TV monitors mounted on the walls of the store, hanging from overhead supports, or mounted in free standing kiosks.

Prior art proposals for video display in retail stores include products that are mounted on the extension of merchandising shelves. These products attach to the front edge of shelves or snap into the shelves' tag moldings. The products protrude into the shopping aisles where shoppers may knock them off or damage them or where they interfere with valuable merchandising space. The products transmit animated messages on small monitors that are usually no larger than three inches tall, two inches deep, and five inches wide. The small size of the devices limits the technology that they can deliver. Small devices have little capacity (including room) to deliver the content that can be delivered with embodiments of the invention, which, at least in preferred forms, will be able to deliver more robust content, using both video and audio.

The present invention provides an improved device for the display of digital content in retail stores, in particular a new shelf unit making it possible to display video and other content in close physical proximity to merchandise to maximize the impact of the information delivered.

SUMMARY OF THE INVENTION

Accordingly, the present invention provides a technology-integrated retail shelf for use in a retail store comprising: an upper surface for providing support for merchandise; a lower surface spaced from the upper surface; a front surface extending between the upper surface and the lower surface at their front edges; a rear surface extending between the upper surface and the lower surface at their rear edges; two side surfaces extending between the upper surface and the lower surface at their side edges and between the front surface and the rear surface; the upper, lower, front, rear and side surfaces together defining an enclosure within which, in use, electronic equipment may be housed; at least one of the surfaces being movable with respect to other of the surfaces to provide access to the interior of the enclosure.

In another aspect, the invention provides a shelf comprising a shelf surface for merchandise adapted to extend substantially horizontally when the shelf is in use; an enclosure associated with the shelf for housing electronic equipment; and a front surface of the shelf extending downwardly from the shelf surface and providing a display face for the shelf.

Electronic components, such as a video display device, audio speakers, a printer or a wireless transmitting device used to deliver content to shoppers in the vicinity of the shelf can be housed securely within the enclosure of the shelf.

Preferably, the front surface comprises a video display screen extending substantially the entire width of the shelf unit. In another preferred form, the front surface includes a graphics channel comprising spaced apart upper and lower channels for receiving printed content. The graphics channel, in a preferred form of the invention, includes a monitor opening that will frame where the monitor is exposed to shoppers, a printer paper outlet and/or a mounting for a magnetic card scanner. The scanner and paper outlet can be on either the right or left side of the monitor opening. The monitor mounts below the sign channel, for example on a monitor pedestal. The monitor pedestal is inside the shelf enclosure and it raises the monitor to a position flush with the monitor opening and the graphics channel. The graphics channel may be hinged down over or on top of the monitor.

The front of the technology-integrated retail shelf is advantageously in the region of 8" tall and the graphics channel includes tracks for holding print signage. The print signage can be apertured to fit around the monitor opening, or can be solid to cover the opening, the paper outlet and the card scanner.

Ideally a single row of the shelves will be positioned within a merchandise category. Each shelf in the row is advantageously hooked into the shelving uprights at between about 36 and 42" high.

Shelves embodying the invention can have a 1¼" DGA-type price tag channel a flush front 1¼" price tag channel, or no price tag channel whatsoever. The shelf is provided preferably in 36", 42" and 48" widths and depths from 18 to 36" in one inch increments. The shelf's upper merchandising surface is preferably either painted or covered with carpet, melamine, or fabric laminate. The shelf's load capacity is preferably between about 250 and 450 lb., preferably approximately 350 lb. The shelf's overall height will preferably be not greater than 4.5 inches. Powered electronic components (e.g., monitor, CPU, wireless device, printer, sensor, power supply, and speakers) will be housed inside the enclosure of the shelf. A card scanner, if provided, resides partially within the shelf enclosure with its input device mounted externally to the graphics channel. A scanner that will read bar codes on merchandise can also be provided mounted on the outer surface of the shelf.

The technology-integrated retail shelf includes at least one and preferably two inlet/outlet openings, advantageously on opposed sides of the rear of the enclosure to provide for the connection of power and data cables to the electronic components.

Retailers can update the networks data by running wires, for example CAT 5 or CAT 6 Ethernet, into the shelf. Retailers can also wirelessly or remotely (via portable devices) update the networks' data. A back channel monitors the systems (e.g., temperature of the displays). An application service provider hosts content. Using preferred forms of the shelf, retailers can service the electronic components within the shelves without having to remove the shelves from the uprights, or having to disturb the merchandise that is on and near the shelves. The exposed parts of the electronic components are durable enough to withstand exposure to shoppers and possible damage from shopping carts. The computer and/or media hardware components are protected from theft because they are housed within the enclosure provided by the shelf. Each shelf preferably includes one or more locks to deter theft and tampering with the equipment. The shelves do not extend into the shopping aisles where they could interfere with shoppers and store personnel as they clean and stock the shelves. Shoppers, especially children, can walk down the shopping aisles without accidentally bumping into the shelves.

Retailers and brand marketers may use the shelf to broadcast targeted messages that link to customers' interests, needs and spending habits. The shelf could also be used to deliver promotions, announcements, product information, retail spots and brand loyalty messages. The shelf could also be used to facilitate television networks, which may not only entertain but also educate shoppers.

The technology-integrated retail shelf has the potential to reinvent in-store shopping because it allows retailers and brand marketers to engage and influence shoppers at the point-of-sale when it is most opportune. The shelf enables content to be displayed that provides shoppers with information about the merchandise on the shelf or content that relates to that merchandise. The shelf facilitates interactive (pull) or non-interactive (push) content, for example, in store networks, answering consumers' questions, recommending products to purchase, or broadcasting advertising to shoppers as they stand in front of the merchandise. The shelf can increase sales of merchandise, make shopping more enjoyable, and complement the retailers' store decors.

Some preferred forms of technology-integrated retail shelf embodying the invention give consumers access to the retailers' in-store selling information. Having the information about the merchandise accessible at the shelf within 18" of the merchandise is advantageous because information delivered at this location is most likely to influence shoppers' decision making when they are standing in front of the merchandise in the shopping aisles. The technology-integrated retail shelf influences shoppers within arms' reach of the merchandise. The shelf's point-of-sale content can not only influence the shoppers' decision making about the merchandise that is positioned on the shelf but also influence decisions about what merchandise to buy off the shelves of the merchandise category. Expecting shoppers to use this point-of-sales information if it is provided from a freestanding kiosk located at a distance from the merchandise is unrealistic. The present invention, at least in preferred forms, improves the bricks and mortar shopping experience by giving store shoppers many of the tools online shoppers now appreciate. The technology-integrated retail shelf provides in-store shoppers with many of the tools previously available only to on-line shoppers.

Preferred forms of the technology-integrated shelf that incorporate touch screen video devices provide access in-store directories that enable shoppers to drill down and locate merchandise by product category (e.g., Coffee), product name (e.g., French Roast), or brand name (e.g., Starbucks®). Advantageously, the video display device may be connected to a computer network and may provide shoppers with the shopping aisle numbers and any other information that will help them find the merchandise in the store.

Retailers may use preferred forms of the shelf that contain a computer or media device connected to a network of the store to assist in supply chain management (inventory management, logistics, and ordering). Also, retailers may promote products in order to increase sales and avoid having to take the merchandise out of inventory to be discounted. In addition, the operations of the retail stores can utilize the video displays to assist store personnel with planogramming by selectively displaying on the video display of the shelf information identifying the merchandise and price tags to be placed at that particular shelf location.

Consumer products have tripled in complexity in the last decade. Overabundance of merchandise in stores presents a challenge for retailers to "filter out the noise" for the shoppers. The average grocery store now has over 970,000 SKUs. However, the average American is loyal to only 650 SKUs, and the typical shopping cart contains only 20 SKUs.

Retailers and brand marketers need to engage and educate shoppers while they are standing in the shopping aisles at the point of purchase using versions of the technology-integrated retail shelf. Using an interface similar to that for shopping on-line, shoppers can drill down to access specifications about merchandise such as dimensions, ingredients, batteries needed, accessories that may be available for the products, warranty information, or details about other products that the retailers may sell only on their websites. The preferred forms of the shelf direct shoppers to consider cross-sell and up-sell merchandise.

Shoppers can also use preferred versions of the shelf to look up replacement part information, e.g., which oil filters or wiper blades fit which cars, which ink refills fit which pens, which printer cartridges fit which printers, which medicine helps which ailment, or which air filters fit which HVAC units.

With preferred version, shoppers may use the shelf to place orders on the retailers' websites for merchandise that is temporarily out-of-stock in the store or available only on the retailers' websites. The shoppers can use the screen to place orders for merchandise and have it delivered to their homes, or to drill down to see if out-of-stock products are available in the retailers' nearby stores.

Using preferred forms of the technology-integrated retail shelf, shoppers may select several items within a product category and compare and contrast the products features in an easy to comprehend format displayed by the video display device, as is commonly possible today on online shopping websites.

Retailers may develop content to display on the shelf's video display that educates shoppers about relevant topics, and shoppers may learn about how merchandise on the shelves relates to these inquiries. For example, shoppers who inquire about diabetes can read about the condition, including dietary considerations, before the programming suggests what merchandise to buy. Shoppers who inquire about termites can learn about the insects before the networks suggest what merchandise in the store to buy that may alleviate the insects. Shoppers can use the networks to look up wedding or shower registries by the registrants' names.

In a preferred embodiment, the shelf includes a printing solution for shoppers. Consumers can print data from the networks, and retrieve the printouts somewhere convenient within the store and preferably from the shelf itself. If shoppers are using the shelves in a store that sells groceries, for example, they may use the video screen to access recipes. Alternatively, content selected by customers can be transmitted wirelessly to the customers' hand-held devices, such as cell phones and PDAs.

At any time during the presentation, shoppers could print or download particular recipes while standing in front of the shelf. The programming may link to manufacturers' coupons for ingredients that are needed to prepare the dishes. Shoppers may use these coupons to purchase the ingredients that they need to prepare the recipes. The print-outs or downloads could list the ingredients the shoppers need to purchase while they are in the store and detail the steps needed to prepare the dishes once the shoppers get home. Shoppers could also watch videos of professional cooks preparing dishes according to the recipes.

A preferred form of the shelves enables shoppers in a DIY store to use a touch screen to look up the tools and materials they need to complete projects. At any time, the shoppers could print out or download the projects, not only getting a print out of the steps needed to perform the projects when they get home but a list of tools and materials they need to purchase while shopping in the store. Manufacturers' coupons that correlate to the tools and materials needed to complete the projects could also be delivered, giving the shopper an incentive to purchase one brand over another for the tools or materials needed to complete the projects. Retailers may develop content in the guided selling content from third parties such as *Consumer Reports, Good Housekeeping, The Food Network, WebMD*, or *Wine Spectator* that give product reviews and makes the shopping experience more rewarding.

Shoppers may use the video displays of the shelves to check prices of merchandise. The addition of an SKU reader underneath the front of the shelf or attached to tag molding on the shelf allows consumers to swipe products to check prices.

In a preferred form of the invention, the video screen of the shelf will televise advertising, which may appear when shoppers are not interacting with the shelf. In addition, the screen may display, in addition to its main content, banner advertisements for different products or services containing links which, when selected by the customer, lead to the display of additional information about the product. Advertising will be positioned directly in front of shoppers at the place and during the time that shoppers are making purchases. When the shelves are idle after a specified amount of time, retailers may output digital content to the shelves, using video and possibly audio. Retailers may rent advertising space on the networks to brand manufacturers that want to run their ads. Retailers may decide to rent space to brand marketers for 15-, 30- or 60-second looping ads that will be positioned as closely as possible to the advertisers' merchandise on the shelves. Alternatively, retailers may decide to run their own in-store advertisements for the stores' most profitable merchandise. Conversely, brand marketers may purchase and give the shelves to the retailers with agreements between the two companies in which the retailers guarantee that the shelves and the content broadcast will be used to promote the brand marketers' particular products and/or services. The technology-integrated retail shelf embodying the invention may air any combination of custom video, in-store television networks, animation, or text. Banner advertising is only one type of advertising that may be featured. The screens could be entirely devoted to advertising content or have more subtle advertising such as banner ads interspersed amongst non-advertising, serious content. If a retailer used the screens to provide shoppers with information, such as medical or health information, the pages could include more academic information along with some banner advertising all on the same page. The banner advertising may pay for the production and maintenance of the more academic content.

The content that the retailers transmit on the shelves may be adjusted to satisfy shopping demographics, including local shopping patterns, the seasons of the year, days of week, or times of the day. The ads that retailers run may be influenced by the demographics that they collect. For example, grocery retailers may run ads for a particular product category from 6 pm to 10 pm on the weekends during the fall if that merchandise historically generates more sales for that category during that time. During the rest of the week at that time, the retailers may broadcast another series of ads that generate more interest.

The shelf may be implemented with "connected-" or "unconnected-displays." "Connected" means that the displays run the same ads all the time. "Unconnected" means that the ads on the displays automatically change based on schedules.

The shelf may be used alone or in tandem with any quantity of similar technology-integrated retail shelves embodying the invention. By adding shelves to the row, retailers may extend the display of digital content for the full length of the shopping aisle or merchandise category. Alternatively, technology-integrated retail shelves embodying the invention may be paired with non-technology-integrated shelves, so retailers can mix and match the digital medium with less expensive print advertising.

Preferably, the in-store digital content can be updated by RSS feeds, using pull, as opposed to push media transfer. Hardware that features solid state capabilities will interface with multiple display types. Store employees should not manage the digital display shown on the shelves: it is better to have remote updating of the displays' content. This allows the appropriate personnel to make one telephone call to change the creative content across many or all stores in a chain.

DETAILED DESCRIPTION OF PREFERRED EMBODIMENTS

Figure 1:
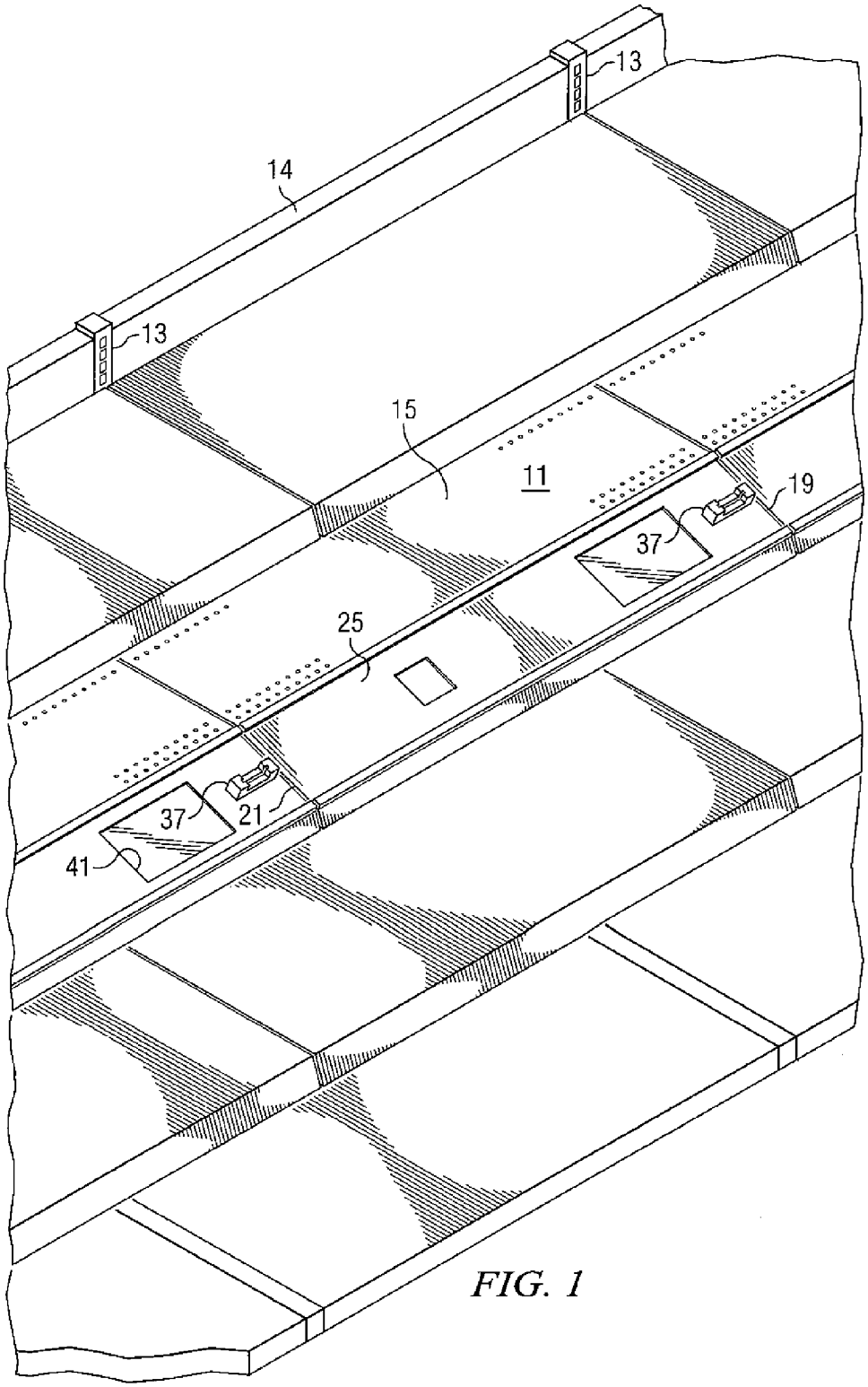
FIG. 1 is a perspective view showing a row of first technology-integrated retail shelves embodying the present invention in their closed condition.
Figure 2:
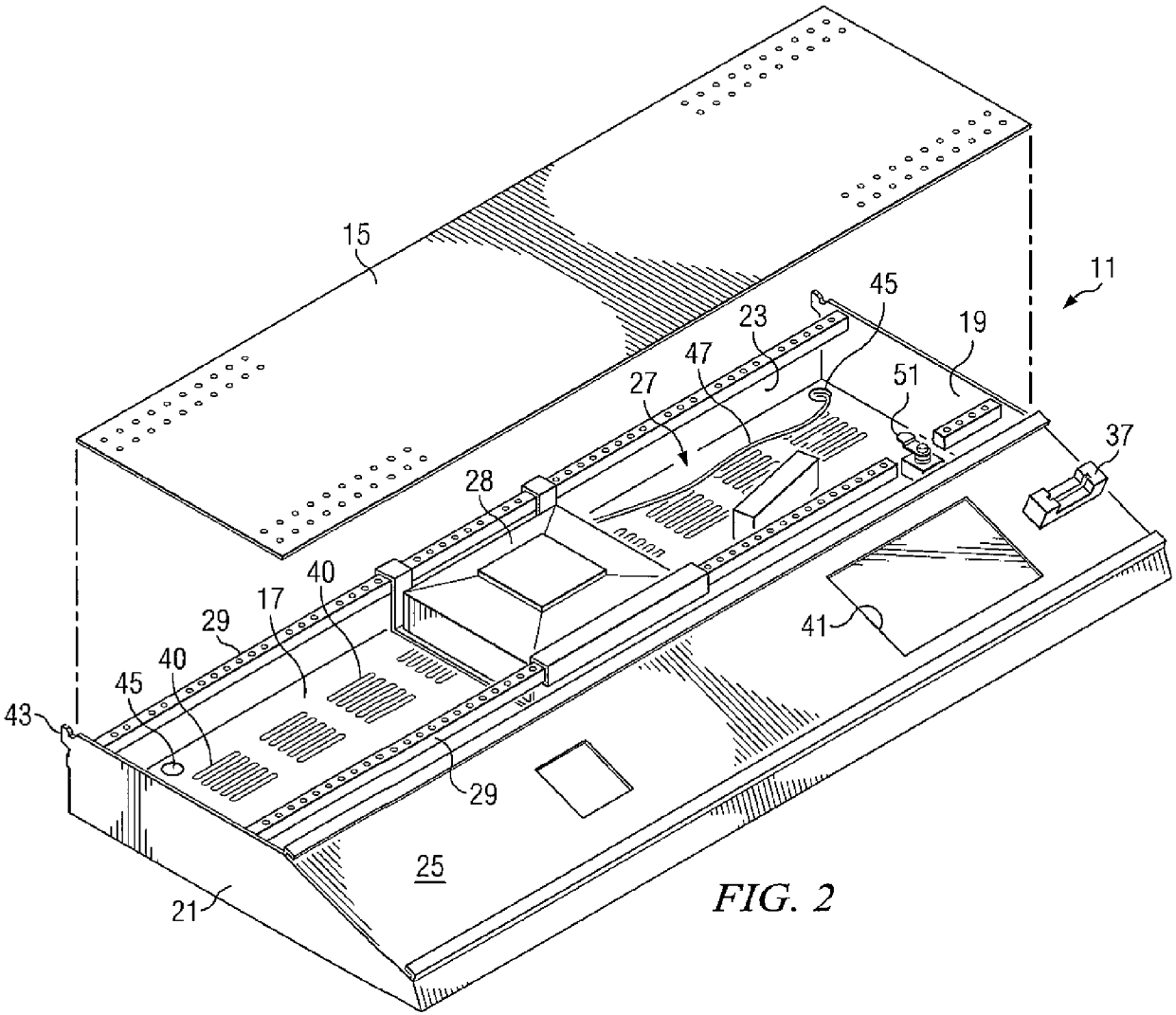
FIG. 2 is a second perspective view of one of the shelves in FIG. 1 in its open condition.

As seen in FIGS. 1 and 2, a first embodiment of the invention comprises a hollow, load bearing shelf 11 mounted on and extending in a cantilevered manner from vertical slotted uprights 13 of a conventional retail shopping gondola or perimeter wall shelving. As shown, the rear of the shelf 11 is positioned against a wall 14 of the gondola or perimeter wall shelving.

The shelf 11 comprises an upper panel 15 which is horizontal when the shelf is mounted on the gondola or perimeter wall shelving and provides a supporting surface for products (not shown). Spaced below the upper panel 15 is a lower panel 17 (FIG. 2) which is disposed in a plane essentially parallel to that of the upper panel 15. The panels 15 and 17 are secured at their side edges to vertical side walls 19, 21 and at their rear edges to a rear wall 23. The lower panel 17 extends from the rear wall 23 about 8" inches further than the upper panel 15. A face or front panel 25 extends downwardly and forwardly from the front edge of the upper panel 15 to the front edge of the lower panel 17. Because of the difference in depth of the panels 15, 17, the face panel 25 is inclined at an angle of about 19.5° from the horizontal, 70.5° from the vertical. The face panel 25 provides a graphics channel for print signage.

Together the panels 15, 17, with the side and rear walls 19, 21, 23 and the face panel 25 define an enclosure 27. The lower panel 17, side and rear walls 19, 21, 23 and face panel 25 are secured together. The upper panel 15 is removably mounted on the side and rear walls 19, 21, 23 and face panel 25 (FIG. 2).

As seen in FIG. 2, two reinforcing cross-bars 29 are provided within the enclosure 27 and extend between the side walls 21, 23, to which the ends of the cross-bars 29 are secured, for example, by welding.

The enclosure 27 is adapted to house electronic devices, such as a thin client computer, or a media player 28, audio speakers (not shown), a printer (not shown), a card reader (not shown) and a video monitor (not shown). An omitted portion 41 in the face panel 25 allows the screen of the video monitor to be seen by a person standing in front of the shelf 11.

The enclosure is vented to allow dissipation of heat generated by operation of the electronic devices, for example, by slots 40 provided in the lower panel 17.

The rear ends of the side walls 19, 21 include hooks 43 for mounting the shelf 11 to the uprights 13 of the gondola or perimeter wall shelving.

Openings 45 in the lower panel 17 are provided for the passage of power supply cables 47 that connect to electronic power sockets (not shown) on the rear wall of the gondola and allow electric power to be provided to the electronic devices. The openings 45 also accommodate data cables for connection to the electronic devices, as desired. The openings 45 also allow for electronic power and data connection between electronic components housed in the respective enclosures of adjacent shelves.

The removable upper panel 15 can be locked in position by rotatable latches 51 operated by keys (not shown) accessible from the underside of the lower panel 17. The latches 51 are fixedly mounted on the upper side of the lower panel 17 and can be engaged with slots provided on the underside of the upper panel 15.

A second embodiment of the invention is shown in FIGS. 3 through 6. Components used in this embodiment that are equivalent to components used in the first embodiment will be identified by the same reference numerals.

Figure 3:
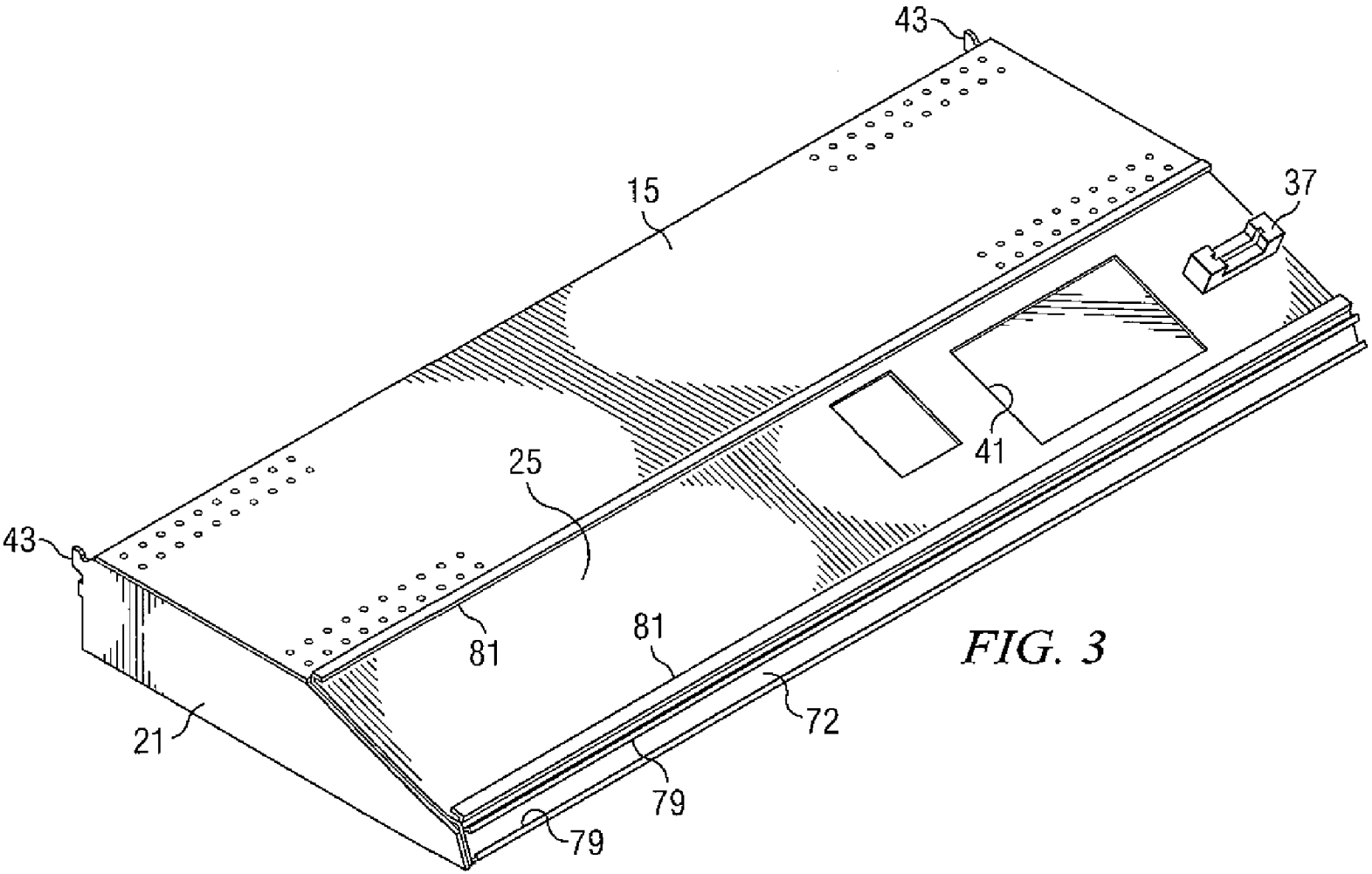
FIG. 3 is a perspective view of a second technology-integrated retail shelf embodying the invention in its closed position.
Figure 4A:
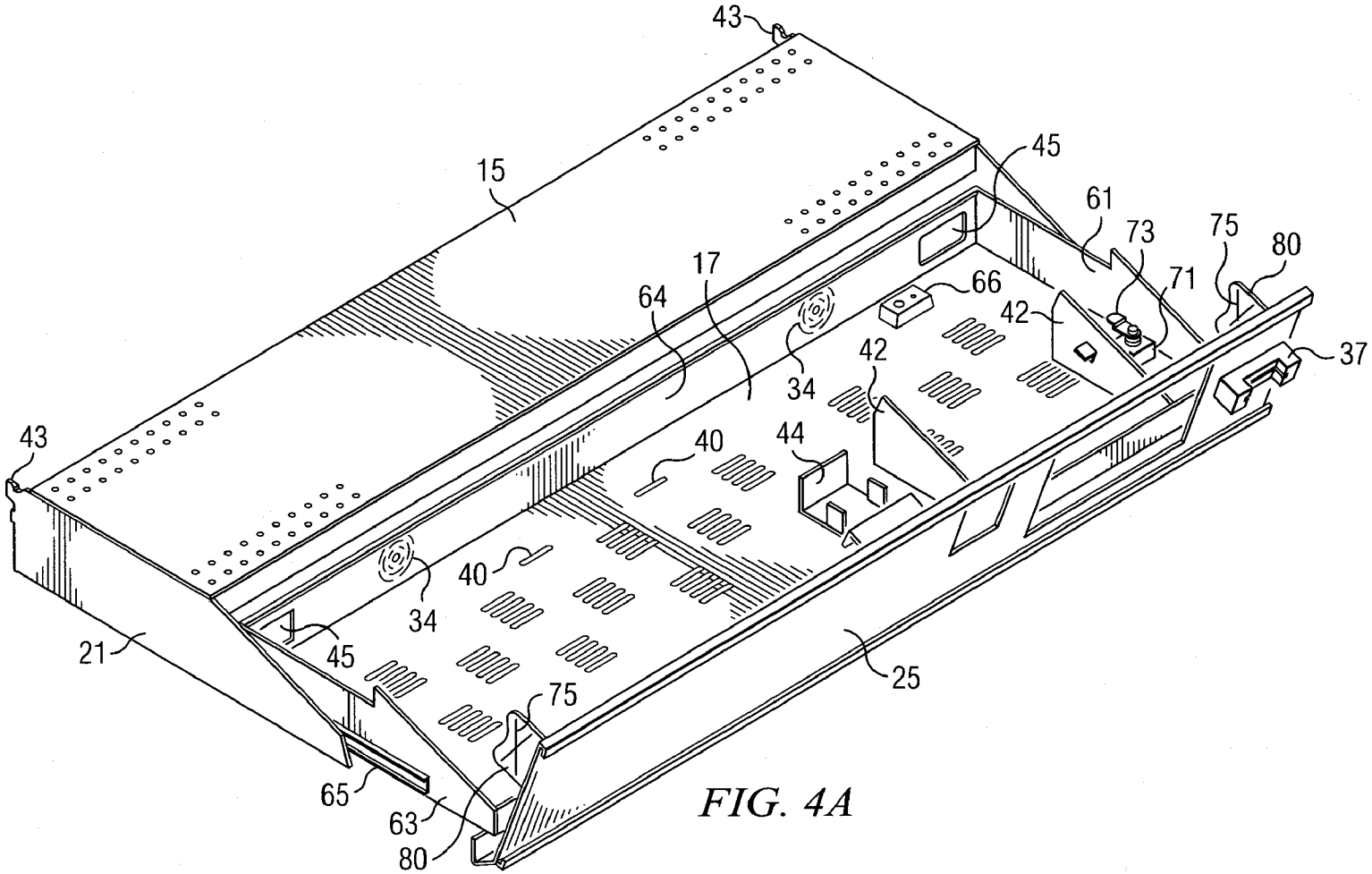
FIG. 4A is a perspective view of the embodiment shown in FIG. 3 in its fully accessible condition, without installed electronic components.

As best seen in FIGS. 3 and 4A, the embodiment comprises an enclosure formed by an upper panel 15 which is adapted to support merchandise to be sold, a lower panel 17, side walls 19, 21, a rear wall 23 and an inclined face panel 25. In this embodiment, however, the upper panel 15 is permanently secured to the side walls 19, 21 and the rear wall 23. The lower panel 17 and face panel 25, together with second side walls 61, 63, and second rear wall 64 form a drawer assembly which is slideably movable with respect to the upper panel 15 and side walls 19, 21 on slides 65 mounted on the side walls 61, 63 which engage rollers (not shown) of two slides (not shown) secured to the interior of the respective side walls 19, 21. Drawer pulls 70 are mounted on the underside of the lower panel 17 to facilitate opening and closing of the drawer assembly.

When closed, the drawer assembly provides an enclosure for electronic components of the shelf. Locks 71 are provided on either side of the drawer assembly. Latches 73 of the locks 71 are adapted to engage with slots 75 in flanges 80 depending from the underside of the face panel 25 and the side walls 61, 63 of the drawer assembly that are in register when the face panel 25 is in its closed position.

In this embodiment, the interior of the enclosure can be accessed by sliding the drawer assembly away from the upper panel assembly without removing merchandise from the upper panel 15. The shelf can be mounted to vertical slotted uprights of a conventional retail gondola, or of a perimeter wall shelving options, for example by hooks 43 the rear of the side walls 19, 21. The shelf is preferably placed between about 36 inches and 46 inches above the floor in front of the shelf, and advantageously with its upper surface about 42" above that floor.

The vertical dimension of the shelf, that is the distance between the lower panel 17 and the upper panel 15, is preferably about 3¾". The shelf has a load bearing capacity of about 350 lbs.

Figure 6:
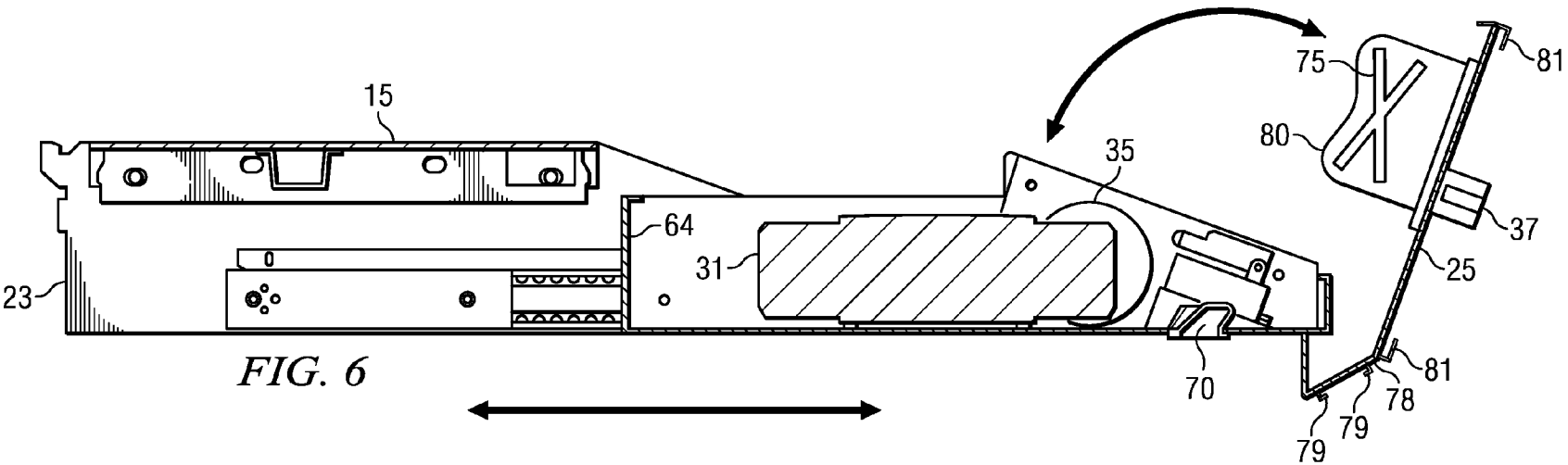
FIG. 6 is a vertical section through the embodiment of FIG. 3 in its fully accessible condition with installed electronic components.

As seen in FIG. 6, the face panel 25 is pivotally connected along its lower edge to the lower panel 17 near that panel's forward edge, so that it can be moved between a closed position (FIGS. 3 and 5) in which it covers the electronic components and an open position (FIGS. 4A and 4B) in which full access to the enclosure is provided.

Figure 4B:
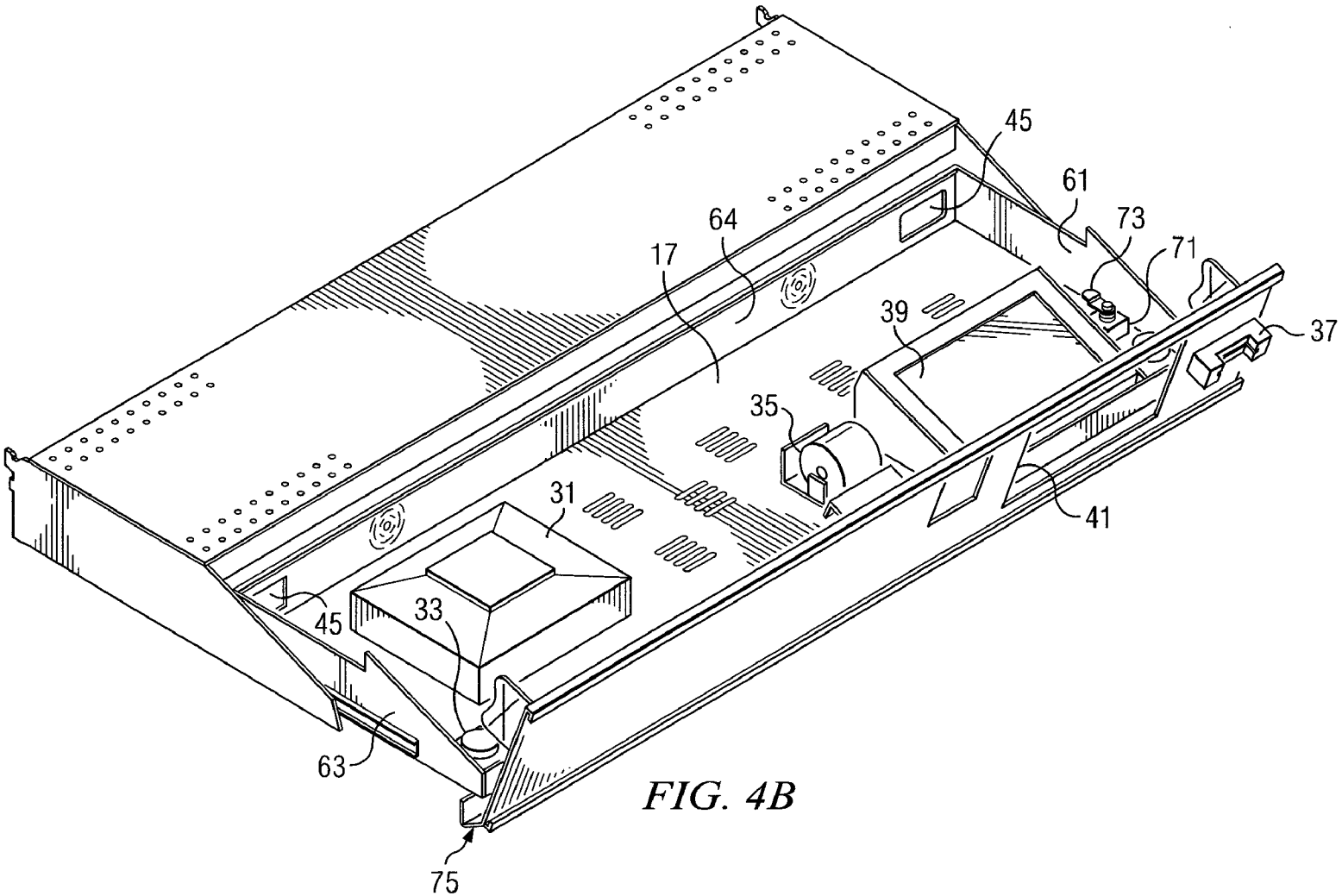
FIG. 4B is a perspective view of the embodiment shown in FIG. 3 in its fully accessible condition, with installed electronic components.
Figure 5:
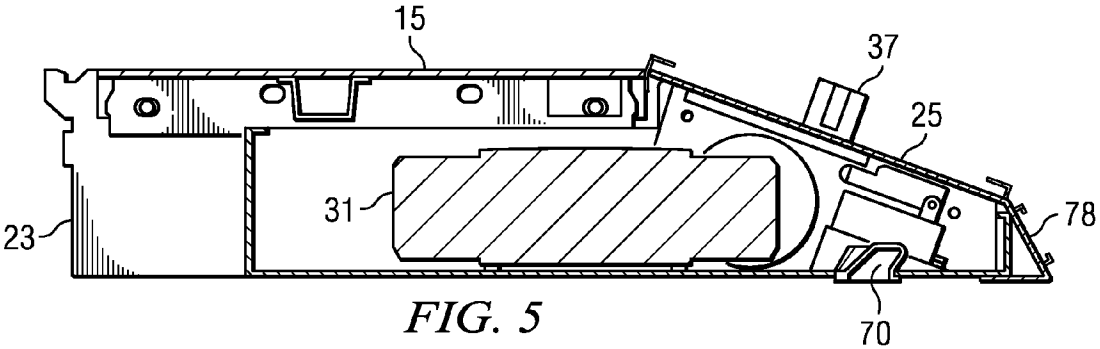
FIG. 5 is a vertical section through the embodiment shown in FIG. 3 in its closed condition with installed electronic components.

Various electronic devices are mounted inside the enclosure. FIG. 4B shows the locations of a thin client computer 31, audio speakers 33, a printer 35, a magnetic card scanner 37 and a color video monitor 39. Suitable thin client computers are the HP Compaq t5530 and t5135 thin client computers. See http://h10010.www1.hp.com/wwpc/yus/en/sm/WFO6a/12454-12454-321959-338927-89307-3341342.html and http://h10010.www1.hp.com/wwpc/yus/en/sm/WFO5a/12454-12454-321959-338927-89307-3341951.html. An alternative embodiment includes a media player in place of the thin client computer. Suitable media players include the Symon SDA series, see http://symon.com/products/targetvision/tv_sda.shtml, and the video system and players available from Data Display Systems, see http://www.datadisplaysystems.com/video/html.

As seen in FIG. 4B, the video monitor 39 is disposed close to the right hand side of the shelf with the card scanner 37 on the right of the monitor 39 and the printer 35 on the left of the monitor 39. Advantageously the monitor 39 is a touch screen monitor that allows customers to request and obtain information from the computer 31 by interfacing with the display on the screen. The ability to interact with the customer through the video screen is an important advantage compared to prior art video display devices used in retail stores, because it allows the customer to obtain information about the product that the customer wants to know at the time a purchasing decision is being made. In addition, the information is made available in close physical proximity to the product.

In addition, an SKU reader (not shown) can be provided enabling the consumer to scan the bar code on a product or package and obtain price information. If needed, one or more fans 34 can be installed in the enclosure to assist with cooling the interior thereof. The enclosure includes mounting locations 40 for wiring and cable restraints, a pedestal 42 for mounting the monitor 39 and a mounting 44 for the printer 35.

The computer or media player 31 can function in a standalone mode using data and processing capability of its own, or can be connected, either by cable or by wireless, to a network with which it communicates in real time.

Openings 45 in the rear wall 64 of the drawer assembly provide access for power and data cables for the electronic components via at least one power outlet 66 within the enclosure. The power cables can be connected to power strips on the gondola, for example the Madix® Electric slidetrack power strip.

As best seen in FIG. 6, the lower edge portion 78 of the face panel 25 is stepped and includes a pair of opposed lips 79 providing a price tag channel to accommodate price or other display inserts. The upper portion of the face panel includes opposed channels 81 providing a graphics channel extending along the width of the shelf for accommodating graphic display elements.

The invention claimed is:

1. A retail shelf unit for delivering product-related content to customers comprising:

a fixed upper shelf surface for displaying products;

an enclosure below the upper shelf surface movable relative to the upper shelf surface between a closed position and an open position;

at least one video display device installed in the enclosure and having a screen for displaying product-related content;

the enclosure comprising a lower surface, two side surfaces, a rear surface and a front face surface which in the closed position cooperates with the upper shelf surface to form a closed space preventing access to the video display device and which, in the open position, allows access to the video display device;

wherein the enclosure is mounted on two pairs of telescoping slides, one slide of each pair being secured to the enclosure and to a vertical sidewall extending from the upper shelf surface;

the front face surface extending when in the closed position downwardly and outwardly from the front of the upper shelf surface and being pivotally connected to the lower surface of the enclosure along the front of the lower surface; and an opening in the front face surface through which the screen of the video display device can deliver product-related content to customers.

2. A retail shelf unit according to claim 1 including at least one lock for securing the enclosure in the closed position.

3. A retail shelf unit according to claim 1 in which the display device has a touch screen allowing interaction between customers and the device.

4. A retail shelf unit according to claim 1 including at least one electrical power outlet within the enclosure for powering the electronic device and at least one electrical power inlet exterior to the enclosure for connecting the power outlet to a source of power.

5. A retail shelf unit according to claim 1 including at least one electronic content outlet within the enclosure for supplying content to the video display device.

6. A retail shelf unit according to claim 1 in which the video display device includes a receiver that receives data wirelessly from a remote location.

7. A retail shelf unit according to claim 1 including at least one electronic content inlet exterior to the enclosure for connecting the content inlet to a remote source of content.

8. A retail shelf unit according to claim 1 wherein the video display device is a computer.

9. A retail shelf unit according to claim 1 including audio speakers housed within the enclosure.

10. A retail shelf unit according to claim 1 in which the vertical separation between the upper shelf surface and the lower surface of the enclosure is between about 3 and 6 inches.

11. A retail shelf unit according to claim 1 in which the vertical separation between the upper shelf surface and the lower surface of the enclosure is about 4.5 inches.

12. A retail shelf unit according to claim 1 including cooling holes in a surface of the enclosure.

13. A retail shelf unit according to claim 1 including tag molds on the front surface.

14. A retail shelf unit according to claim 1 including horizontal reinforcing structure in the enclosure extending between the side surfaces and disposed adjacent the underside of the upper surface.

15. A retail shelf unit according to claim 1 including a magnetic card reader accessible from the exterior of the shelf.

16. A retail shelf unit according to claim 1 including a printer having its outlet accessible from the exterior of the shelf.

17. A retail shelf unit according to claim 1 including mounts for positioning removable graphic display on front face surface of the enclosure.

18. A retail shelf unit according to claim 1 in which the front face surface includes spaced apart upper and lower channels to receive printed content.

19. A retail shelf unit as claimed in claim 1 in which part of the front face surface comprises spaced apart channels for holding printed content.

20. A method of promoting sales of merchandise in a retail store including providing a shelf unit as claimed in claim 1, providing a display device within the enclosure of the shelf, the display device having a screen, positioning the screen to be visible through the opening in the enclosure, displaying on the screen content that is relevant to customers in the store.

21. A method of promoting sales in a retail store as claimed in claim 20 wherein the display device includes a touch screen enabling customers to obtain information about merchandise via the touch screen.

22. A method according to claim 20 including connecting the display device to a computer network and obtaining information from a location remote from the shelf unit and displaying it on the screen.

23. A method according to claim 20, and enabling the consumer to request delivery of retail coupons for the merchandise on the shelf.

24. A method according to claim 20, including enabling the customer to order merchandise to be delivered to the customer at an address remote from the store.

* * * * *